US008934792B2

(12) United States Patent
Mashiki

(10) Patent No.: US 8,934,792 B2
(45) Date of Patent: Jan. 13, 2015

(54) STATUS DETECTION DEVICE, IMAGE FORMING APPARATUS INCLUDING THE SAME, AND METHOD FOR CONTROLLING STATUS DETECTION DEVICE

(71) Applicant: KYOCERA Document Solutions Inc., Osaka (JP)

(72) Inventor: Masami Mashiki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/065,514

(22) Filed: Oct. 29, 2013

(65) Prior Publication Data

US 2014/0119749 A1 May 1, 2014

(30) Foreign Application Priority Data

Oct. 31, 2012 (JP) ..... 2012-240306

(51) Int. Cl.
*G03G 15/20* (2006.01)
*G03G 15/00* (2006.01)

(52) U.S. Cl.
CPC ..... *G03G 15/2078* (2013.01); *G03G 15/2039* (2013.01); *G03G 15/80* (2013.01)
USPC ..... 399/33; 399/37; 399/67; 399/88; 399/90

(58) Field of Classification Search
CPC ..... G03G 15/50; G03G 15/5004; G03G 15/2039; G03G 15/5037; G03G 15/80
USPC ..... 399/33, 67–71, 88, 90
See application file for complete search history.

(56) References Cited

U.S. PATENT DOCUMENTS

| | | | | |
|---|---|---|---|---|
| 8,494,389 | B2 * | 7/2013 | Takami | 399/69 |
| 2008/0267643 | A1 * | 10/2008 | Takami | 399/33 |
| 2009/0060551 | A1 * | 3/2009 | Lee et al. | 399/70 |
| 2009/0074442 | A1 * | 3/2009 | Sano et al. | 399/69 |
| 2010/0322656 | A1 * | 12/2010 | Chosokabe et al. | 399/67 |
| 2011/0123208 | A1 * | 5/2011 | Inukai | 399/37 |
| 2011/0274450 | A1 * | 11/2011 | Atarashi | 399/37 |
| 2011/0274456 | A1 * | 11/2011 | Higashi et al. | 399/88 |
| 2011/0318039 | A1 * | 12/2011 | Watanabe | 399/69 |
| 2012/0224874 | A1 * | 9/2012 | Takami | 399/67 |
| 2013/0028623 | A1 * | 1/2013 | Inukai | 399/69 |

FOREIGN PATENT DOCUMENTS

JP 2009-251275 A 10/2009

* cited by examiner

*Primary Examiner* — Clayton E Laballe
*Assistant Examiner* — Ruifeng Pu
(74) *Attorney, Agent, or Firm* — Morgan, Lewis & Bockius LLP

(57) ABSTRACT

A status detection device includes a heater, a first power line for supplying power to one end of the heater, a second power line for supplying power to the other end of the heater, a switch portion disposed in the first power line, an overheat protection portion for disconnecting the second power line when temperature exceeds a predetermined temperature, and a zero cross signal generation portion which outputs a zero cross signal in accordance with a waveform of an AC power supply, and outputs zero cross signals having different output values in a case where voltage of the first power line is higher than voltage of the second power line and in a case where the voltage of the second power line is higher than, the first power line.

15 Claims, 9 Drawing Sheets

STATUS DETECTION DEVICE, IMAGE FORMING APPARATUS INCLUDING THE SAME, AND METHOD FOR CONTROLLING STATUS DETECTION DEVICE

CROSS-REFERENCE TO RELATED APPLICATIONS

This application is based on and claims the benefit of priority from the corresponding Japanese Patent Application No. 2012-240306 filed on Oct. 31, 2012, the entire contents of which are hereby incorporated by reference.

BACKGROUND

The present disclosure relates to a status detection device which includes a heater for heating a toner image transferred onto a paper sheet and detects a status about power supply to the heater. In addition, the present disclosure relates to an image forming apparatus including the status detection device.

An electric apparatus such as an image forming apparatus (e.g. a printer, a multifunction peripheral, a copier, or a FAX machine) operates using electric power supplied from an AC power supply such as a commercial power source. If the power supply to the image forming apparatus is abruptly turned off because of a certain reason such as a power failure or a malfunction, data being processed may be lost. In addition, the sudden turn-off of the power supply may cause a damage to the image forming apparatus. Therefore, in order to detect whether or not the AC power is being supplied from the AC power supply, a zero cross signal may be generated on the basis of a voltage (current) of the AC power supply.

As described below, there is known an image forming apparatus which detects whether or not the AC power is being supplied from the AC power supply on the basis of the zero cross signal. Specifically, there is known an image forming apparatus, in which a power voltage monitoring circuit for monitoring an input of the AC power supply is disposed, the power voltage monitoring circuit detects that power supply to a power supply unit is interrupted, and changes a DCP-REDY signal as a power supply monitoring signal. The power voltage monitoring circuit generates a zero cross signal. Then, if the zero cross signal is not supplied during a predetermined time period (for example, 100 ms), it is determined that the AC input is interrupted, and the DCP-REDY signal is dropped to low level.

As described above, the image forming apparatus may detect power supply from the AC power supply or turn-off thereof (ON/OFF of power supply). In addition, the detection may be performed concerning a plurality of items such as whether or not power is supplied normally from the AC power supply, whether or not an input for stopping power supply to the heater or the like is performed, and whether or not disconnection has occurred in the path from the AC power supply to the heater. In this way, the image forming apparatus may detect a plurality of items concerning status of the image forming apparatus.

In accordance with detection items, sensors and components (elements) for detection are disposed respectively. Then, sensor output values and voltage values near the components are supplied to a control circuit (control portion) such as a CPU. Then, on the basis of the output values or voltage values supplied from the sensors, the control circuit detects or recognizes status of the image forming apparatus concerning a plurality of items.

Here, conventionally, one signal line is used for one sensor or component for detection so as to perform input to a port of the control circuit such as the CPU. For instance, if there are four detection items, four sensors are disposed, and four signal lines are disposed for input from the four sensors to the control circuit. Therefore, the signal lines for input to the control circuit increases along with an increase of the detection items.

Further, when a plurality of items concerning the status are detected as described above, signal lines to be wired in the apparatus may be increased. Therefore, the wiring becomes complicated so that time and effort for wiring are increased. In addition, a large space for wiring in the apparatus is necessary. In addition, a problem concerning manufacturing cost may occur. In addition, because it is necessary to use a control circuit (for example, a CPU) having many input ports, a problem concerning manufacturing cost or flexibility in selecting the control circuit may occur.

Note that the known image forming apparatus described above detects ON/OFF of a power switch by a power switch monitoring switch and detects whether or not the AC power is supplied by the power voltage monitoring circuit, in which one switch or circuit is used for one item to be detected as before. Therefore, in the above-mentioned known image forming apparatus, wiring becomes complicated so that time and effort for the wiring is increased, and it is necessary to secure a large space for the wiring. In addition, it is difficult to solve the problem that manufacturing cost cannot be reduced.

SUMMARY

The present disclosure is made in view of the above-mentioned problem of the conventional technique. A status detection device according to a first aspect of the present disclosure includes a heater, a first power line, a second power line, a switch portion, an overheat protection portion, a zero cross signal generation portion. The heater heats a toner image transferred onto a paper sheet. The first power line connects the heater to an AC power supply so that power is supplied to one end of the heater. The second power line connects the heater to an AC power supply so that power is supplied to the other end of the heater. The switch portion is disposed in the first power line between the heater and the AC power supply so as to turn on and off the power supply. The overheat protection portion is disposed in the second power line between the heater and the AC power supply so as to disconnect the second power line when temperature exceeds a predetermined value. The zero cross signal generation portion outputs a zero cross signal on the basis of a first power line voltage between the switch portion and the heater as well as a second power line voltage between the overheat protection portion and the heater in accordance with a waveform of the AC power supply. The zero cross signal generation portion outputs the zero cross signal having different output values in the case where the first power line voltage is higher than the second power line voltage and in the case where the second power line voltage is higher than the first power line voltage.

Further features and advantages of the present disclosure will become apparent from the description of embodiments given below.

DETAILED DESCRIPTION

Now, with reference to FIGS. 1 to 13, embodiments of the present disclosure are described using examples of a printer 100 (corresponding to an image forming apparatus) including a status detection device 1 and a zero cross signal generation portion 2. However, elements such as structures and layouts described in the embodiments are merely examples for description and do not limit the scope of the disclosure.

(Outline of Image Forming Apparatus)

Figure 1:
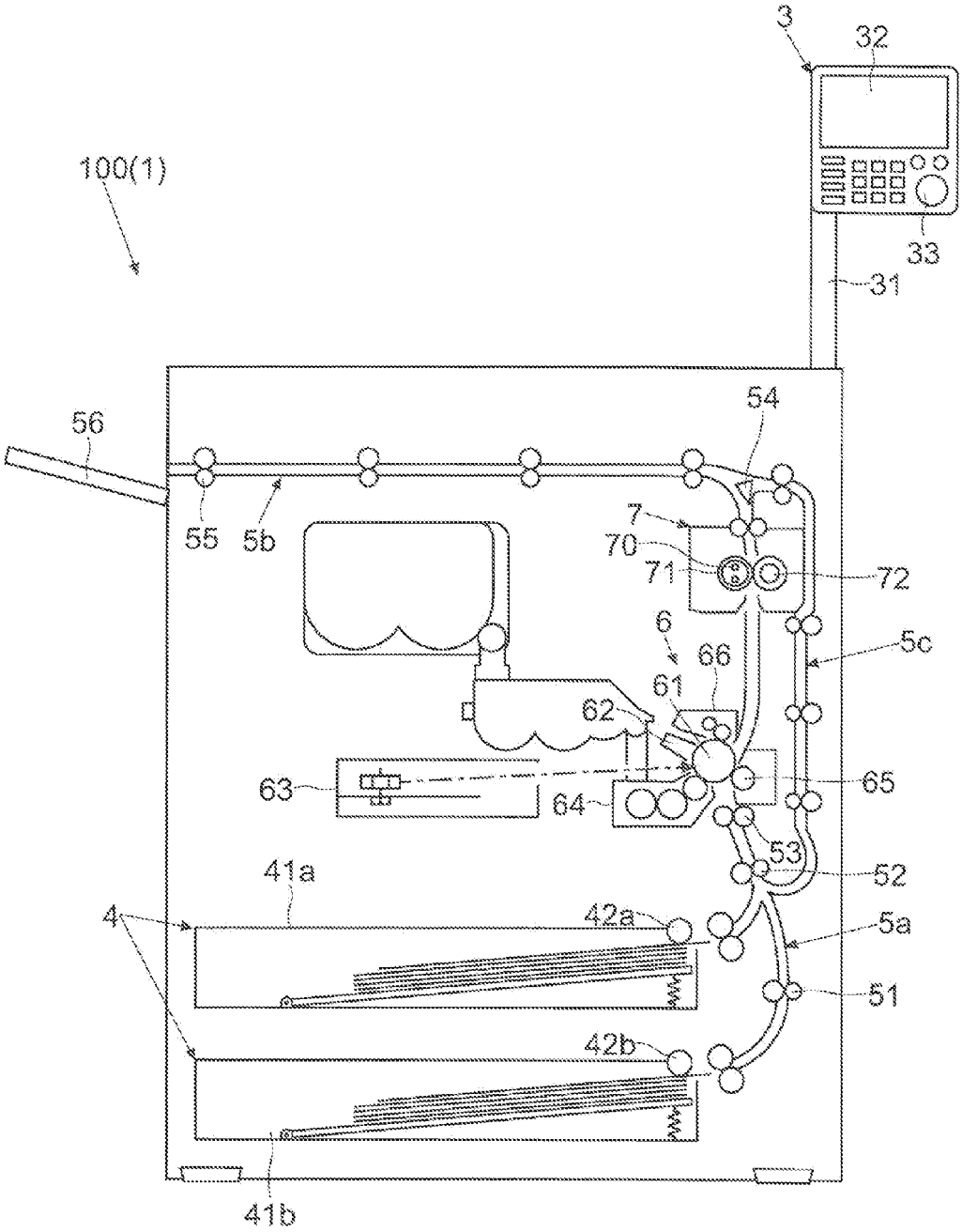
FIG. 1 is a cross-sectional view illustrating a schematic structure of a printer according to an embodiment.

First, with reference to FIG. 1, outline of the printer 100 according to the embodiment is described. FIG. 1 is a cross-sectional view illustrating a schematic structure of the printer 100.

As illustrated in FIG. 1, the printer 100 of this embodiment includes an operation panel 3 (corresponding to notifying portion) attached to the side.

The operation panel 3 is disposed on a distal end of the arm 31 disposed on the upper right side of the printer 100. Further, the operation panel 3 includes a display portion 32 (for example, a liquid crystal display panel) for displaying a status of the printer 100, various messages, and a setting screen. The display portion 32 is a touch panel type (for example, a resistive membrane type). In addition, the operation panel 3 is equipped with a plurality of hardware keys 33 for various setting.

For instance, the operation panel 3 displays a status of the printer 100, cautions, error messages on the display portion 32. Thus, the operation panel 3 notifies a user about the status. In addition, for example, the operation panel 3 has a role as an operation portion, which accepts setting by the user about a print condition such as a type and a size of the paper sheet to be used for printing, or accepts an input for canceling a displayed error state.

In addition, as illustrated in FIG. 1, the printer 100 includes a paper sheet feeder 4, a first conveying portion 5*a*, an image forming portion 6, a fixing portion 7, a second conveying portion 5*b*, a double-sided printing conveying portion 5*c* and the like.

The paper sheet feeder 4 is disposed in the lower part of the printer 100. The paper sheet feeder 4 includes a plurality of cassettes 41 (an upper cassette is denoted by 41*a*, and a lower cassette is denoted by 41*b* in FIG. 1). For instance, each of the cassettes 41 stores sheets of any type such as copy paper sheets, OHP sheets or label paper sheets. The cassettes 41 are respectively equipped with paper feed rollers 42 driven to rotate by a motor M (see FIG. 3) (an upper roller is denoted by 42*a*, and a lower roller is denoted by 42*b* in FIG. 1). The paper feed roller 42 rotates so as to send out the paper sheet to the first conveying portion 5*a*.

Further, the first conveying portion 5*a* conveys the paper sheet in the printer 100. The first conveying portion 5*a* guides the paper sheet fed from the paper sheet feeder 4 to the image forming portion 6. The first conveying portion 5*a* is equipped with convey roller pairs 51 and 52, a registration roller pair 53 and the like. The registration roller pair 53 permits the conveyed paper sheet to wait before the image forming portion 6 (transfer roller 65) and sends out the same in synchronization with timing.

The image forming portion 6 forms a toner image on the basis of image data of an image to be formed. In addition, the image forming portion 6 transfers the formed toner image onto the paper sheet. The image forming portion 6 includes a photoreceptor drum 61, an electrification portion 62, an exposing portion 63, a developing portion 64, the transfer roller 65, a cleaning portion 66 and the like.

The photoreceptor drum 61 bears the toner image on the circumference surface and is driven to rotate at a predetermined process speed. The electrification portion 62 charges the photoreceptor drum 61 at a constant potential. The exposing portion 63 emits a laser beam (illustrated by a dot-dashed line) on the basis of an input image signal (image data). The exposing portion 63 scans and exposes the charged photoreceptor drum 61 so as to form an electrostatic latent image on the surface of the photoreceptor drum 61.

The developing portion 64 supplied toner to the photoreceptor drum 61 so as to develop the electrostatic latent image. The cleaning portion 66 cleans the photoreceptor drum 61. The transfer roller 65 is pressed to the photoreceptor drum 61. Further, the registration roller pair 53 sends out the paper sheet to a nip between the photoreceptor drum 61 and the transfer roller 65 in synchronization with formation of the toner image. Further, a predetermined transfer voltage is applied to the transfer roller 65. Thus, the toner image is transferred onto the paper sheet.

The fixing portion 7 is disposed on a downstream side of the image forming portion 6 in a paper sheet convey direction. The fixing portion 7 heats and presses the toner image transferred onto the paper sheet so as to fix the toner image. The fixing portion 7 includes a heat roller 71 heated by a heater 70 (see FIG. 4) and a pressure roller 72 pressed to the heat roller 71. Further, the paper sheet with the transferred toner image passes through the nip between the heat roller 71 and the pressure roller 72 so as to be heated and pressed. As a result, the toner image is fixed to the paper sheet. Note that the fixed paper sheet is directed to the second conveying portion 5*b* disposed above the fixing portion 7.

The paper sheet discharged from the fixing portion 7 is conveyed through the second conveying portion 5*b* extending substantially horizontally from a branch portion 54 toward the left side surface of the printer 100. A discharge roller pair 55 discharges the printed paper sheet to a discharge tray 56. Further, when the double-sided printing is performed, the paper sheet discharged from the fixing portion 7 is temporarily sent out from the branch portion 54 in the direction toward the discharge tray 56, and then the convey direction is switched back in the direction toward the right side surface of the printer 100, so that the paper sheet is guided to the double-sided printing conveying portion 5*c*. Further, the paper sheet passes through the branch portion 54 and is sent downward through the double-sided printing conveying portion 5*c*. Then, the paper sheet is sent again to the registration roller pair 53 via the first conveying portion 5*a*.

(Hardware Structure of Printer 100)

Figure 2:
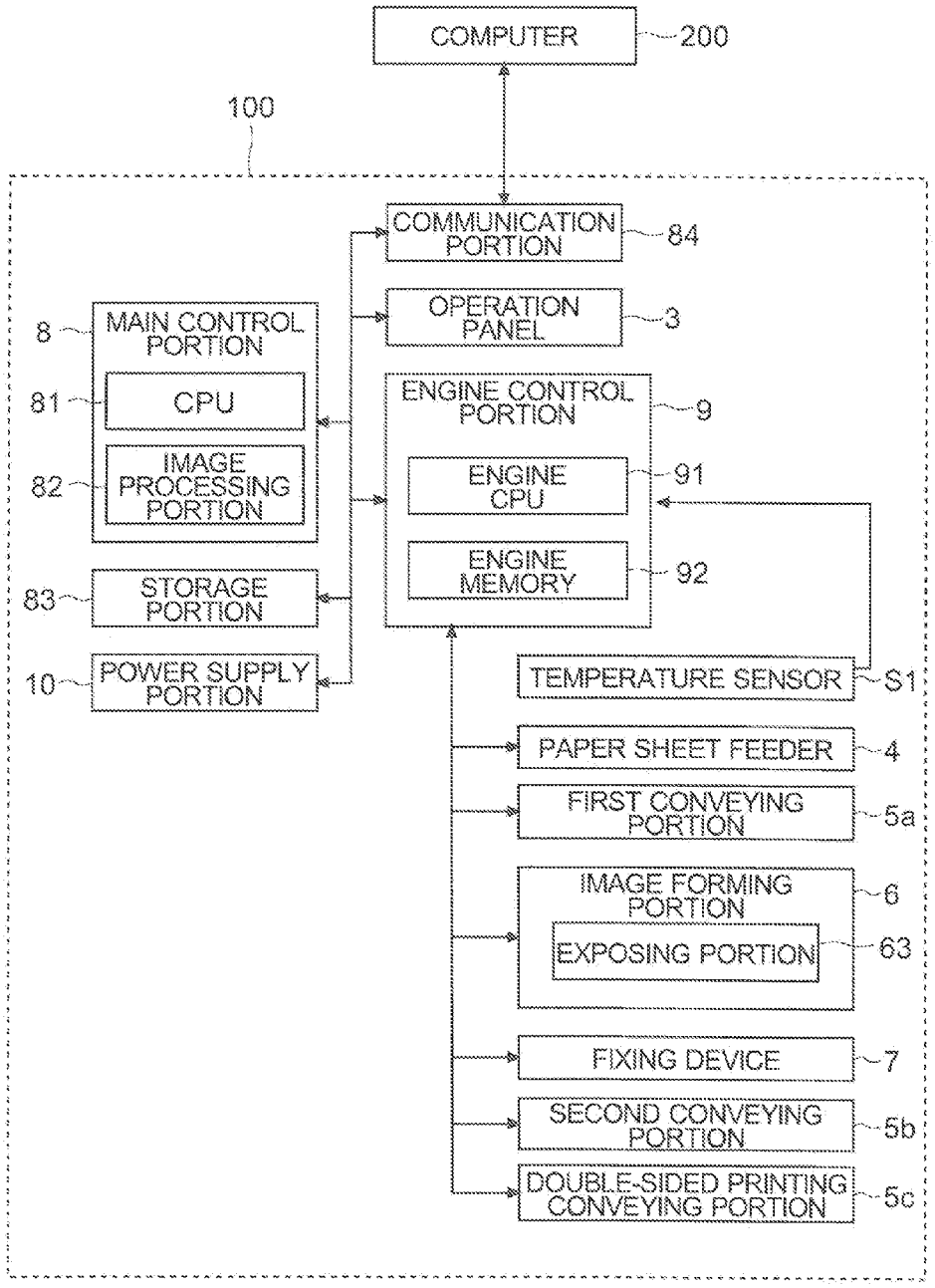
FIG. 2 is a block diagram illustrating a hardware structure of a printer according to the embodiment.

Next, with reference to FIG. 2, a hardware structure of the printer 100 according to the embodiment is described. FIG. 2 is a block diagram illustrating the hardware structure of the printer 100.

As illustrated in FIG. 2, the printer 100 according to the embodiment includes a main control portion 8. For instance, the main control portion 8 includes a CPU 81, and an image processing portion 82. The CPU 81 performs various calculations and signal processing. Specifically, the CPU 81 is a central processing unit and performs controls and calculations of individual portions of the printer 100 on the basis of a control program, control data, set data and the like, which are stored in a storage portion 83 and are loaded. The image processing portion 82 performs image processing on the image data. The main control portion 8 controls the CPU 81 and the image processing portion 82 to perform various processing and controls individual portions of the printer 100.

The storage portion 83 is constituted as a combination of a volatile storage device and a nonvolatile storage device, such as a ROM, a RAM, a flash ROM, an HDD and the like. For instance, the storage portion 83 stores the control program, the control data and the like for the printer 100.

In addition, the main control portion 8 is connected to the operation panel 3 and the like so as to recognize settings made by the operation panel 3. In addition, the main control portion 8 controls the display portion 32 of the operation panel 3 to display information indicating a status of the printer 100 such as an occurrence of an error or an abnormality.

In addition, the main control portion 8 is connected to a communication portion 84. The communication portion 84 is a communication interface for performing communication with a computer 200 (for example, a personal computer or a server) as a transmission source of print data containing image data for printing and setting data on printing via a network, a cable or a public line. The communication portion 84 receives the print data from the computer 200.

The image processing portion 82 performs various image processing such as enlargement, reduction, rotation, density conversion, data format conversion and the like on the image data received from the computer 200 in accordance with setting data contained in the print data. Further, when the print job is performed, the image processing portion 82 sends the image data after the image processing to the exposing portion 63. The exposing portion 63 receives the image data so as to perform the scanning and exposure.

In addition, the main control portion 8 is connected to an engine control portion 9 so that communication can be performed between them. The engine control portion 9 controls printing portions (engine portion) such as the paper sheet feeder 4, the first conveying portion 5*a*, the image forming portion 6, the fixing portion 7, the second conveying portion 5*b*, and the double-sided printing conveying portion 5*c*. The engine control portion 9 controls operation of the engine portion so as to perform printing on the basis of instructions from the main control portion 8. For instance, the engine control portion 9 performs control for forming the toner image, control of the motor M for rotating various rotating members, and paper sheet convey control so as to control printing. Note that the function of the engine control portion 9 may be included in the main control portion 8 so that the engine control portion 9 and the main control portion 8 are integrated to be one control portion.

For instance, the engine control portion 9 includes an engine memory 92 for storing programs and data concerning print control. Further, the engine control portion 9 includes an engine CPU 91. The engine CPU 91 performs calculation and processing concerning control of printing on the basis of the programs and data stored in the engine memory 92.

(Power Supply System in Printer 100)

Figure 3:
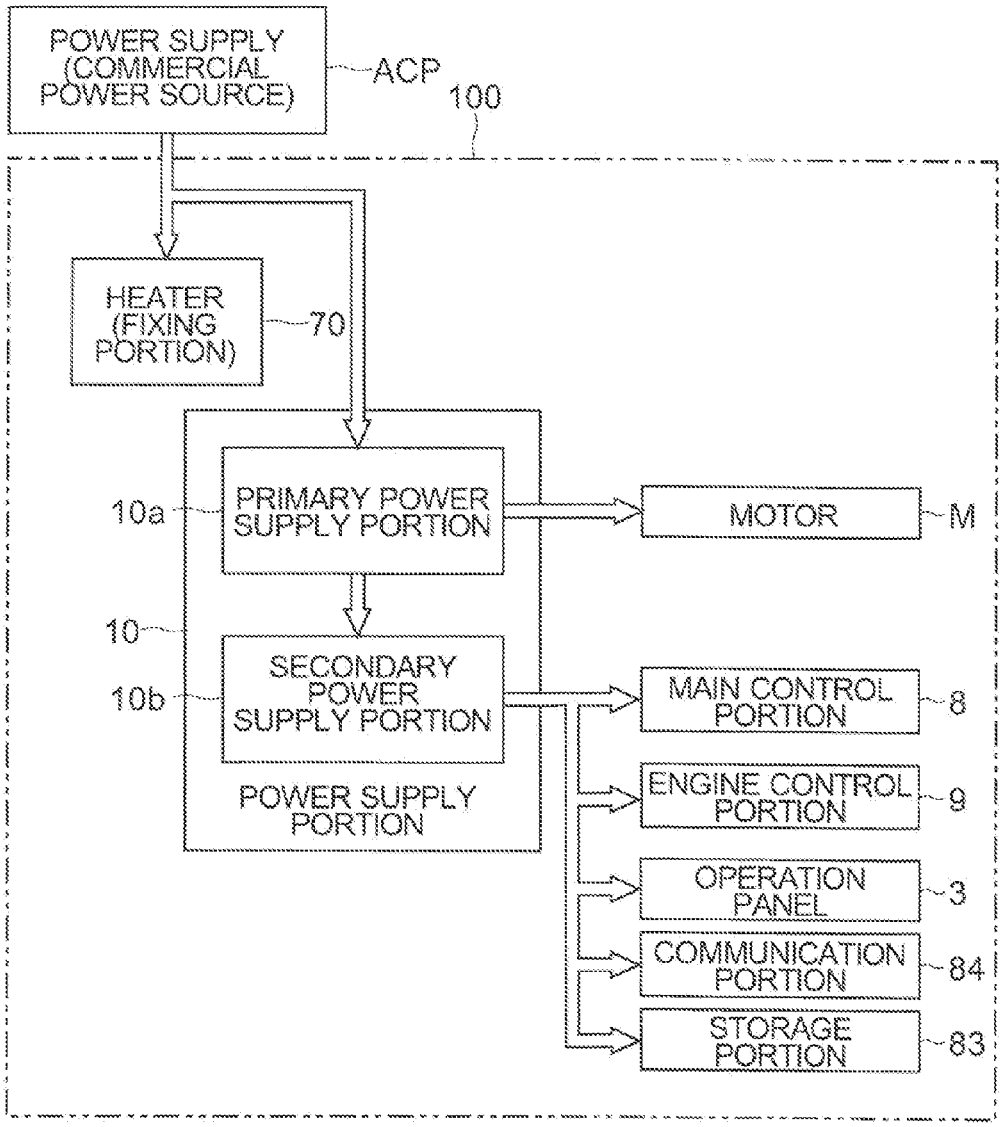
FIG. 3 is a block diagram illustrating a power supply system in the printer according to the embodiment.

Next, with reference to FIG. 3, an example of a power supply system in the printer 100 according to the embodiment is described. FIG. 3 is a block diagram illustrating a power supply system in the printer 100. Note that FIG. 3 illustrates a flow of power supply by a white arrow.

The printer 100 of this embodiment is connected to an outlet of an external AC power supply ACP (for example, a commercial power source) via a power cable (not shown). The printer 100 includes a power supply portion 10 for generating various voltages necessary for operation of the image forming apparatus (see FIG. 2). The main control portion 8 controls operation of the power supply portion 10.

Further, power supplied from the AC power supply ACP is supplied to a primary power supply portion 10*a*. In addition, power from the AC power supply ACP is supplied to the heater 70 of the fixing portion 7 so that the heater 70 generates heat.

The primary power supply portion 10*a* is an AC-DC converter. For instance, the primary power supply portion 10*a* includes a full-wave rectification circuit, a transformer, a smoothing circuit and the like, so as to generate a DC voltage from an AC voltage. For instance, the primary power supply portion 10*a* generates a DC voltage (for example, DC 24V) for a plurality of motors M for rotating various rotating members for paper sheet conveying, toner image formation, and fixing (various rotating members included in the paper sheet feeder 4, the first conveying portion 5*a*, the image forming portion 6, the fixing portion 7, the second conveying portion 5*b* and the double-sided printing conveying portion 5*c*) disposed in the printer 100. In other words, the primary power supply portion 10*a* generates a DC voltage for DC motors disposed in the printer 100. Note that only one motor M is illustrated in FIG. 3 for convenience sake. For instance, the individual motors M rotate the paper feed roller 42, the convey roller pairs 51 and 52, the registration roller pair 53, the photoreceptor drum 61, the heat roller 71, the discharge roller pair 55 and the like, in printing.

Further, the power (voltage) generated by the primary power supply portion 10*a* is also supplied to a secondary power supply portion 10*b*. The secondary power supply portion 10*b* steps down the DC voltage generated by the primary power supply portion 10*a* so as to generate DC voltages (for example, DC 5V, 3.3V, 1.8V, 1.5V and the like) for various circuits included in the main control portion 8, the engine control portion 9, the operation panel 3, the communication portion 84, the storage portion 83 and the like. For instance, the secondary power supply portion 10*b* generates and supplies voltages for driving the CPU 81, the memory, the chip, the circuit and the like. A plurality of secondary power supply portions 10*b* are disposed in accordance with voltages to be generated and places (only one secondary power supply portion 10*b* is illustrated in FIG. 3 for convenience sake).

(Outline of Status Detection Device 1)

Figure 4:
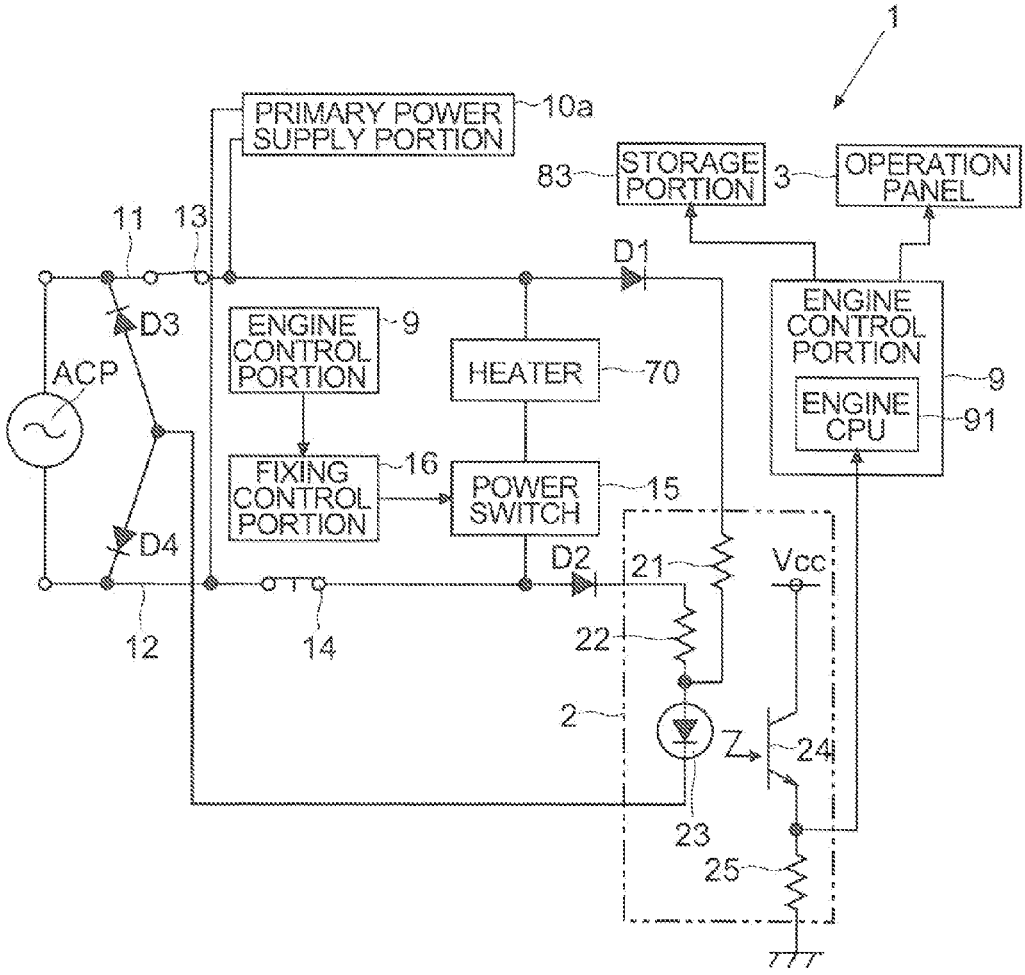
FIG. 4 is a circuit diagram illustrating a status detection device according to the embodiment.

Next, with reference to FIG. 4, an example of the status detection device according to the embodiment 1 is described. FIG. 4 is a circuit diagram illustrating the status detection device 1.

The status detection device 1 of this embodiment is included in the printer 100 and detects a status concerning power supply to the heater 70 of the fixing portion 7. In other words, the status detection device 1 is included in the power supply system for the heater 70. Specifically, the status detection device 1 includes a first power line 11, a second power line 12, the heater 70, a main switch 13 (corresponding to a switch portion), an overheat protection portion 14, the zero cross signal generation portion 2, the engine control portion 9 (corresponding to a recognition portion), the operation panel 3, the storage portion 83 and the like.

The first power line 11 and the second power line 12 are power lines for connecting the heater 70 to the AC power supply ACP. In case where a commercial power source is used as the AC power supply ACP, for example, the first power line 11 is connected to a live side (L side) while the second power line 12 is connected to a neutral side (N side). Note that the live side and the neutral side may be connected oppositely. In other words, the first power line 11 is a conductor line for connecting one terminal of the heater 70 to the AC power supply ACP. In addition, the second power line 12 is a conductor line for connecting the other terminal of the heater 70 to the AC power supply ACP.

The heater 70 generates heat by power supplied from the AC power supply ACP. The heater 70 generates heat for fixing the toner image so as to heat the heat roller 71. For instance, a halogen heater or an induction heater can be used as the heater 70 (it is sufficient that the heater can be mounted in the fixing portion 7 and can generate necessary heat).

A power supply switch 15 and a fixing control portion 16 are disposed. The power supply switch 15 is a switch for switching between supply and interruption of power to the heater 70 (on and off of the power supply). The fixing control portion 16 controls supply and interruption of power to the heater 70 by the power supply switch 15. For instance, the power supply switch 15 is a semiconductor switch (for example, a triac).

For instance, the engine control portion 9 is connected to a temperature sensor S1 for detecting temperature of the heat roller 71 (see FIG. 2). Further, the engine control portion 9 recognizes temperature of the heat roller 71 on the basis of an output of the temperature sensor S1. Before printing is started or during printing, the engine control portion 9 issues instructions to the fixing control portion 16. Further, the engine control portion 9 controls supply and interruption of power to the heater 70 so that temperature of the heat roller 71 is maintained at a predetermined appropriate temperature for fixing a toner image (fixing control temperature). For instance, the engine control portion 9 controls output (power consumption) of the heater 70 per unit time in accordance with a paper sheet size and current temperature of the heat roller 71 so as to maintain the temperature of the heat roller 71 at the fixing control temperature. Note that the engine control portion 9 may directly control the power supply switch 15 without using the fixing control portion 16 (without disposing the fixing control portion 16), so as to control supply and interruption of power to the heater 70.

Further, the main switch 13 is disposed in the first power line 11 between the AC power supply ACP and the heater 70 (in the first power line 11 on the side closer the AC power supply ACP than the heater 70). The main switch 13 mechanically switches between supply and interruption of power to the heater 70 so as to turn on and off the power supply. As illustrated in FIG. 4, the main switch 13 is disposed closer to the AC power supply ACP than a node between the primary power supply portion 10*a* and the first power line 11. It is also possible to switch between supply and interruption of power to the primary power supply portion 10*a* by turning on and off the main switch 13. In other words, the main switch 13 is operated by the user in order to power off the printer 100 (to interrupt the power supply to turn off the main power), and to power on (to turn on the main power). Further, when the power is not supplied to the secondary power supply portion 10*b* and the latter part of the secondary power supply portion 10*b* (the main control portion 8 and the like as illustrated in FIG. 3), the printer 100 is maintained in a non-working state (in which the main power is turned oft). Therefore, the main switch 13 may be disposed between the primary power supply portion 10*a* and the secondary power supply portion 10*b*. It is also possible to dispose the main switch 13 between the secondary power supply portion 10*b* and a part that works when power is supplied from the secondary power supply portion 10*b* (the main control portion 8, the engine control portion 9, the operation panel 3 or the storage portion 83). In other words, the main switch 13 may be disposed as a switch for turning on and off the power supply to the secondary power supply portion 10*b* and the latter part of the secondary power supply portion 10*b* after the primary power supply portion 10*a*. In addition, the main switch 13 may be disposed on a side surface of the printer 100 or may be disposed as a hardware key 33 in the operation panel 3.

In addition, an overheat protection portion 14 is disposed in the second power line 12 between the AC power supply ACP and the heater 70 (in the second power line 12 closer to the AC power supply ACP than the heater 70). When the temperature of the heater 70 exceeds a predetermined temperature (for example, approximately 250 to 300 degrees Celsius), the overheat protection portion 14 disconnects the second power line 12 so as to prevent excess temperature rise. For instance, the overheat protection portion 14 is a component called a thermocut, a temperature fuse, a thermal protector, a thermostat or the like. When the overheat protection portion 14 detects excess temperature rise so as to cause a disconnected state, current from the AC power supply ACP is not supplied to the heater 70 so that the state where the power supply to the heater 70 is interrupted can be maintained.

The zero cross signal generation portion 2 outputs a signal switching between high and low levels depending on whether or not a potential difference (an absolute value of a potential difference) between the first power line 11 and the second power line 12 exceeds a predetermined potential difference. In the example of this embodiment, when the potential difference between the first power line 11 and the second power line 12 exceeds the predetermined potential difference, the high level is output. When the potential difference between the first power line 11 and the second power line 12 becomes the predetermined potential difference or lower, the low level is output. Further, during a period of the low level, the potential difference between the first power line 11 and the second power line 12 (voltage of the AC power supply ACP) becomes zero (ground level). Further, specifically, the zero cross signal generation portion 2 of this embodiment includes a first resistor 21, a second resistor 22, a light emitting portion 23, a light receiving portion 24, a third resistor 25 and the like.

For instance, the light emitting portion 23 is a light emitting diode (LED). Note that the light emitting portion 23 is not limited to the LED and may be an electric light bulb that emits light by electric power and. Further, the first resistor 21 and the second resistor 22 are connected in parallel to the light emitting portion 23. Specifically, an anode of the light emitting portion 23, an end of the first resistor 21, and an end of the second resistor 22 are connected.

Further, the other end of the first resistor 21 is connected to the first power line 11 between the main switch 13 and the heater 70 via a first diode D1 Therefore, in the state where the main switch 13 is closed, the voltage of the first power line 11 is higher than that of the second power line 12, and the potential difference is larger than the predetermined potential difference, current is supplied to the light emitting portion 23 through the first resistor 21. When the current is supplied to the light emitting portion 23 through the first resistor 21, the light emitting portion 23 emits light.

In addition, the other end of the second resistor 22 is connected to the second power line 12 between the overheat protection portion 14 and the heater 70 via a second diode D2. Therefore, in the state where the second power line 12 is not disconnected by the overheat protection portion 14, the voltage of the second power line 12 is higher than that of the first power line 11, and the potential difference is larger than the predetermined potential difference, current is supplied through the second resistor 22 to the light emitting portion 23. When the current is supplied to the light emitting portion 23 through the second resistor 22, the light emitting portion 23 emits light.

Further, a cathode of the light emitting portion 23 is connected to the first power line 11 via a third diode D3 and is connected to the second power line 12 via a fourth diode D4. In other words, the cathode of the light emitting portion 23 is connect to the first power line 11 and the second power line 12 so that current is supplied to a low potential power line out of the first power line 11 and the second power line 12.

Here, in a path of the current supplied to the light emitting portion 23, a plurality of diodes (the first diode D1 to the fourth diode D4) are disposed. Note that the first diode D1 to the fourth diode D4 may have the same specification. In addition, it is possible to consider that the first diode D1 to the fourth diode D4 are included in the zero cross signal generation portion 2.

Further, in order that the current is supplied to the light emitting portion 23, the potential difference (the absolute value of the potential difference) between the first power line 11 and the second power line 12 increases to be larger than a forward voltage drop of the light emitting portion (LED) 23 and a forward voltage drop of a combination of the first diode D1 and the fourth diode D4 or a combination of the second diode D2 and the third diode D3, so that the light emitting portion 23 emits light.

Further, the above-mentioned predetermined potential difference is determined based on a forward voltage drop of each diode and the light emitting portion 23 until the current is supplied to the light emitting portion 23. For instance, the predetermined potential difference is approximately a few volts. The predetermined potential difference can be adjusted by diodes to be used, and the number of diodes disposed between the light emitting portion 23 and the first power line 11 as well as the second power line 12.

Further, the light emitting portion 23 is turned off during a period from when the potential difference (the absolute value of the potential difference) between the first power line 11 and the second power line 12 becomes the predetermined potential difference or smaller until the potential difference between the first power line 11 and the second power line 12 exceeds the predetermined potential difference again after the potential difference becomes zero in the voltage waveform of the AC power supply ACP.

The light receiving portion 24 is disposed at a position for receiving light from the light emitting portion 23. For instance, the light receiving portion 24 is a phototransistor. A collector of the light receiving portion 24 (phototransistor) is applied with a power voltage Vcc generated by the secondary power supply portion 10*b* or the like. In addition, an emitter of the light receiving portion 24 is connected to the ground via the third resistor 25. When the light receiving portion 24 receives light from the light emitting portion 23 (when the light emitting portion 23 emits light), the light receiving portion 24 becomes conductive. When the light receiving portion 24 becomes conductive, current flows in the direction from the power voltage Vcc to light receiving portion 24, to the third resistor 25, and further to the ground. Further, a voltage between the light receiving portion 24 and the third resistor 25 is supplied to the engine CPU 91 as an output value of the zero cross signal generation portion 2, for example.

Therefore, the zero cross signal output from the zero cross signal generation portion 2 (a signal supplied to the engine CPU 91) becomes high when the potential difference (the absolute value of the potential difference) between the first power line 11 and the second power line 12 exceeds the predetermined potential difference, and becomes low when the potential difference (the absolute value of the potential difference) between the first power line 11 and the second power line 12 becomes the predetermined potential difference or smaller. Further, the zero cross signal becomes a signal indicating that the potential difference between the first power line 11 and the second power line 12 becomes zero (ground level) during a period of the low level.

(Operations and Outputs of the Status Detection Device 1 in Normal Power Supply State and in Power Supply Stop State)

Figure 5:
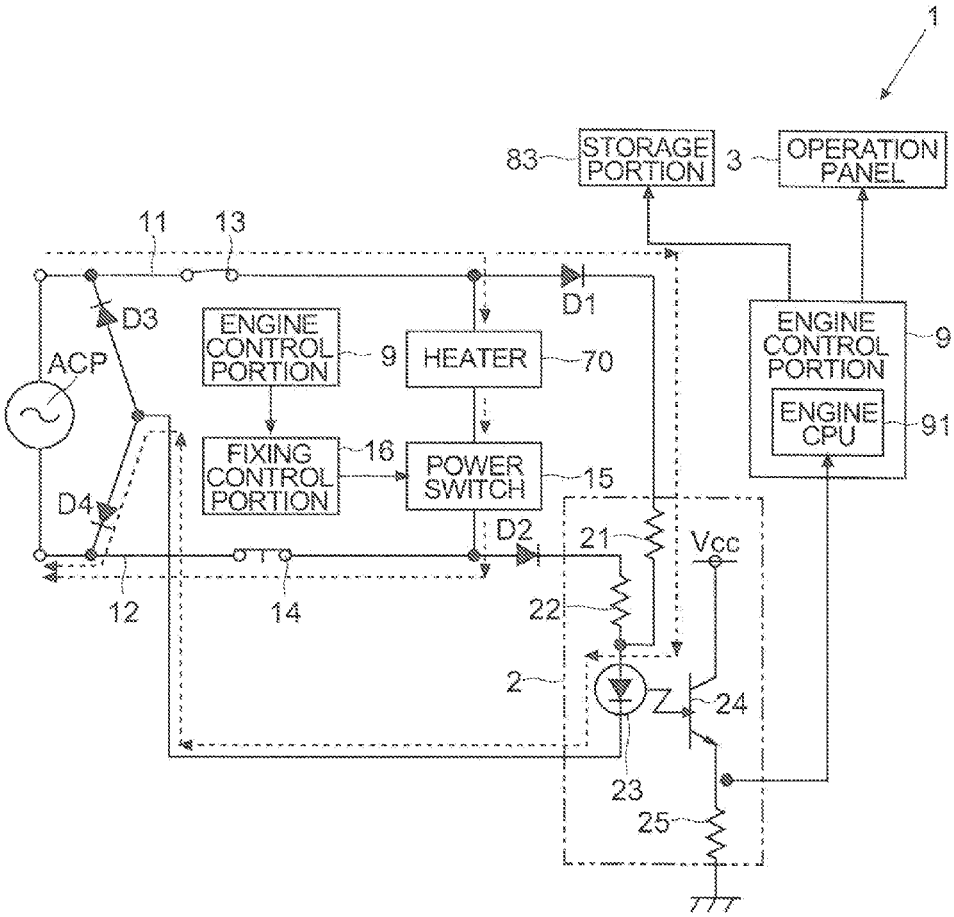
FIG. 5 is a circuit diagram illustrating a current flow in the status detection device according to the embodiment.
Figure 6:
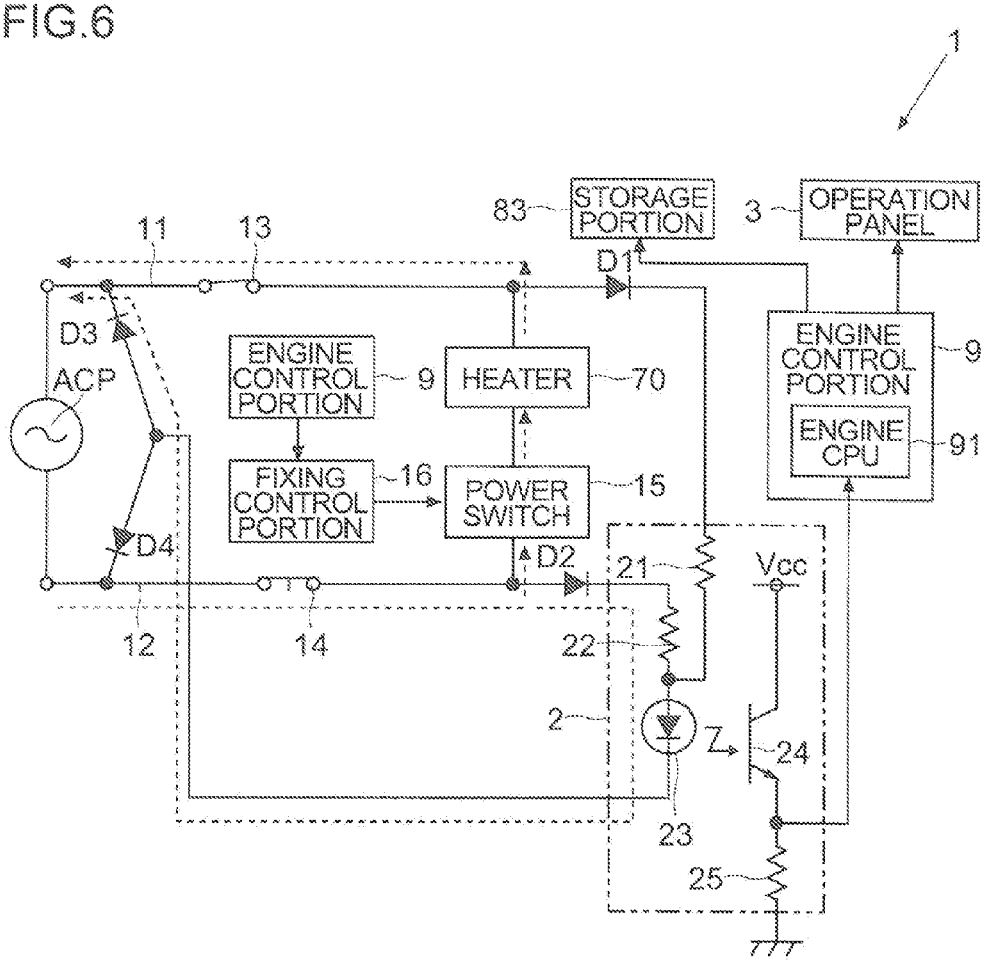
FIG. 6 is a circuit diagram illustrating a current flow in the status detection device according to the embodiment.
Figure 7:
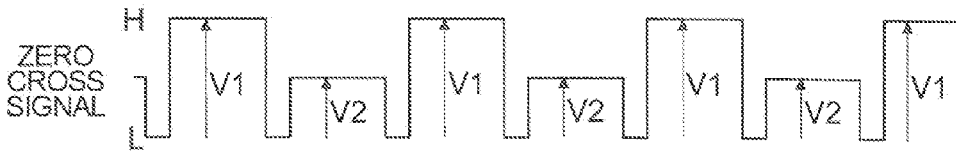
FIG. 7 is a timing chart illustrating an output of a zero cross signal generation portion in a normal power supply state according to the embodiment.
Figure 8:
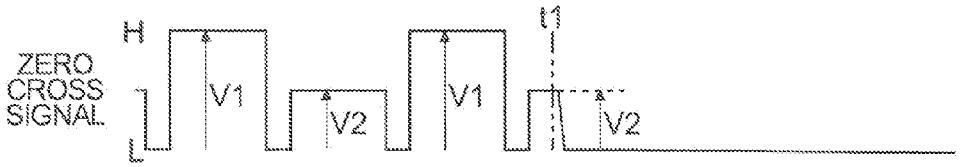
FIG. 8 is a timing chart illustrating an output of the zero cross signal generation portion in a power supply stop state according to the embodiment.

Next, with reference to FIG. 5 to FIG. 8, there is described an example of the operation and the output of the status detection device 1 concerning a normal power supply state and a power supply stop state. FIG. 5 and FIG. 6 are circuit diagrams illustrating a current flow of the status detection device 1. FIG. 7 is a timing chart illustrating an output of the zero cross signal generation portion 2 in the normal power supply state. FIG. 8 is a timing chart illustrating an output of the zero cross signal generation portion 2 in the power supply stop state.

First, with reference to FIG. 5, a current flow in the state where the voltage of the first power line 11 is higher than that of the second power line 12 (potential in the first power line 11 is higher) in the normal power supply state is described. Here, the normal power supply state is a state where the power supply to the heater 70 is not interrupted by the main switch 13. In addition, the normal power supply state is a state where the overheat protection portion 14 works so that disconnection does not occur in the second power line 12. Further, the state where the voltage of the first power line 11 is higher and the state where the voltage of the second power line 12 is higher are periodically (for example, at a period of the commercial power source) repeated so that power is normally supplied from the AC power supply ACP.

When the voltage of the first power line 11 becomes higher than that of the second power line 12, and the power supply switch 15 is turned on, current flows in the direction from the first power line 11 to the heater 70, to the power supply switch 15, and further to the second power line 12 as illustrated in FIG. 5. In addition, when the potential difference (absolute value of the potential difference) between the first power line 11 and the second power line 12 increases to exceeds the predetermined potential difference, current flows in the direction from the first power line 11 to first diode D1, to the first resistor 21, to the light emitting portion 23, to the fourth diode D4, and further to the second power line 12. Thus, the light emitting portion 23 emits light. Further, when the light receiving portion 24 becomes conductive, a high level signal is supplied to the engine CPU 91.

Next, with reference to FIG. 6, a current flow in the state where a voltage of the second power line 12 is higher than that of the first power line 11 (potential of the second power line 12 is higher) in the normal power supply state is described. When the voltage of the second power line 12 is higher than that of the first power line 11, and the power supply switch 15 is turned on, current flows in the direction from the second power line 12 to the power supply switch 15, to the heater 70, and further to the first power line 11 as illustrated in FIG. 6. In addition, when the potential difference (absolute value of the potential difference) between the first power line 11 and the second power line 12 increases to exceed the predetermined potential difference, current flows in the direction from the second power line 12 to second diode D2, to the second resistor 22, to the light emitting portion 23, to the third diode D3, and further to the first power line 11. Thus, the light emitting portion 23 emits light. Further, when the light receiving portion 24 becomes conductive, a high level signal is supplied to the engine CPU 91.

Next, with reference to FIG. 7, there is described a waveform of the zero cross signal output by the zero cross signal generation portion 2 in the normal power supply state.

First, in the status detection device 1 of this embodiment, the first resistor 21 and the second resistor 22 have different resistance values. For instance, the resistance of the second resistor 22 is larger than that of the first resistor 21 by two to several times. Therefore, the light emitting portion 23 has different light emission intensity between the case where the current supplied from the first resistor 21 causes light emission and the case where the current supplied from the second resistor 22 causes light emission.

Therefore, received light intensity of the light receiving portion 24 is different between the case of receiving light emitted by current supplied through the first resistor 21 and the case of receiving light emitted by current supplied through the second resistor 22. Therefore, the light receiving portion 24 is supplied with different current values in the case where the light emitting portion 23 emits light by the current supplied through the first resistor 21 (the voltage of the first power line 11 is higher than the voltage of the second power line 12) and in the case where the light emitting portion 23 emits light by the current supplied through the second resistor 22 (the voltage of the second power line 12 is higher than the voltage of the first power line 11).

In this embodiment, the current supplied to the light emitting portion 23 when the voltage of the first power line 11 is larger than the voltage of the second power line 12 is larger than the current supplied to the light emitting portion 23 when the voltage of the second power line 12 is larger than the voltage of the first power line 11. Therefore, the output value of the zero cross signal (output value of the light receiving portion 24) when the voltage of the first power line 11 is larger than the voltage of the second power line 12 is larger than the output value of the zero cross signal when the voltage of the second power line 12 is larger than the voltage of the first power line 11. In other words, the zero cross signal generation portion 2 outputs zero cross signals having different output values in the case where the voltage of the first power line 11 is larger than the voltage of the second power line 12 and in the case where the voltage of the second power line 12 is larger than the voltage of the first power line 11.

Further, in the following description, the output value in case where the zero cross signal becomes high when the light receiving portion 24 receives the light emitted from the light emitting portion 23 when the voltage of the first power line 11 is larger than the voltage of the second power line 12 (output value in which high amplitude is larger) is referred to as a "first output value V1". In addition, the output value in case where the zero cross signal becomes high when the light receiving portion 24 receives the light emitted from the light emitting portion 23 when the voltage of the second power line 12 is higher than the voltage of the first power line 11 (output value of smaller amplitude of high level) is referred to as a "second output value V2".

Further, as illustrated in FIG. 7, in the normal power supply state, the zero cross signal output from the zero cross signal generation portion 2 rises (changes from high to low in a period) at a period (for example, 1/100 seconds or 1/120 seconds) corresponding to a frequency of the AC power supply ACP (for example, 50 Hz or 60 Hz). Further, as to the output value when the zero cross signal becomes high, the first output value V1 and the second output value V2 are repeated alternately. Specifically, a high level of the first output value V1 and a high level of the second output value V2 appear alternately in a manner like "first output value V1 to low level, to the second output value V2, to the low level, to the first output value V1, and so on". In other words, the output value of the zero cross signal generation portion 2 switches between the first output value V1 and the second output value V2 every half a period of the AC power supply (commercial power source) in accordance with zero cross every half a period of a sine wave of the AC power supply (commercial power source).

The engine control portion 9 (engine CPU 91) can recognize whether to be the normal power supply state or not on the basis of the input zero cross signal. The engine control portion 9 can recognize to be the normal power supply state by recognizing that the output value whose amplitude has changed by amount due to resistance values of the first resistor 21 and the second resistor 22 is output from the zero cross signal generation portion 2. Specifically, it is possible to recognize that the zero cross signal switches between high level and low level at a constant period and the amplitude has changed by amount due to resistance values of the first resistor 21 and the second resistor 22 whenever the zero cross signal switches the high level. In addition, it is possible to determine in advance a width of a voltage value output as the first output value V1 and a width of a voltage value (output value width) output as the second output value V2, and to recognize that the amplitude has changed on the basis of whether or not each output value is within a predetermined width of voltage value.

Next, with reference to FIG. 8, a zero cross signal waveform in the power supply stop state is described. First, the power supply stop state means a state where power cannot be supplied from the commercial power source due to power failure or disconnection of the power cable (in which the first power line 11 and the second power line 12 have the same potential level).

For instance, FIG. 8 illustrates an example of a waveform of the zero cross signal when the power supply stop state occurs at time point t1 indicated by a double-dotted-dashed line. When the power supply stop state occurs, the potential of the first power line 11 becomes the same as the potential of the second power line 12. Then, the zero cross signal does not becomes the high level even at the time point at which the high level of the first output value V1 should be output, and the high level zero cross signal does not becomes the high level (maintains the low level) even at the time point at which the high level of the second output value V2 should be output The engine control portion 9 (engine CPU 91) can recognize whether or not to be the power supply stop state on the basis of the input zero cross signal. Specifically, the engine CPU 91 recognizes to be the power supply stop state when there is no high level after a time period of the high level of the zero cross signal (time period from a leading edge to a trailing edge) corresponding to two periods (one period of the waveform of the AC power supply ACP).

For instance, when recognizing to be the power supply stop state, the engine control portion 9 controls the storage portion 83 to store a predetermined type of data in a nonvolatile manner during the period until the main control portion 8, the storage portion 83 and the like are stopped when the output voltage of the secondary power supply portion 10*b* becomes lower than a voltage value necessary for driving each circuit. Note that the engine control portion 9 may transmit data indicating that the power supply stop state has occurred to the main control portion 8, and the main control portion 8 may issue an instruction to the storage portion 83 so that the storage portion 83 stores the predetermined type of data in a nonvolatile manner.

The data to be stored in the storage portion 83 before driving is stopped can be determined arbitrarily. For instance, it is possible to control the storage portion 83 to store data concerning various count value such as the total number of printed sheets or the number of printed dots, or life of members included in the printer 100. In addition, it is possible to control the storage portion 83 to store data under being processed (under printing or being received by the communication portion 84), for example, in order that the process can be resumed promptly after power is supplied again.

(Recognition that Main Switch 13 is Turned Off)

Figure 9:
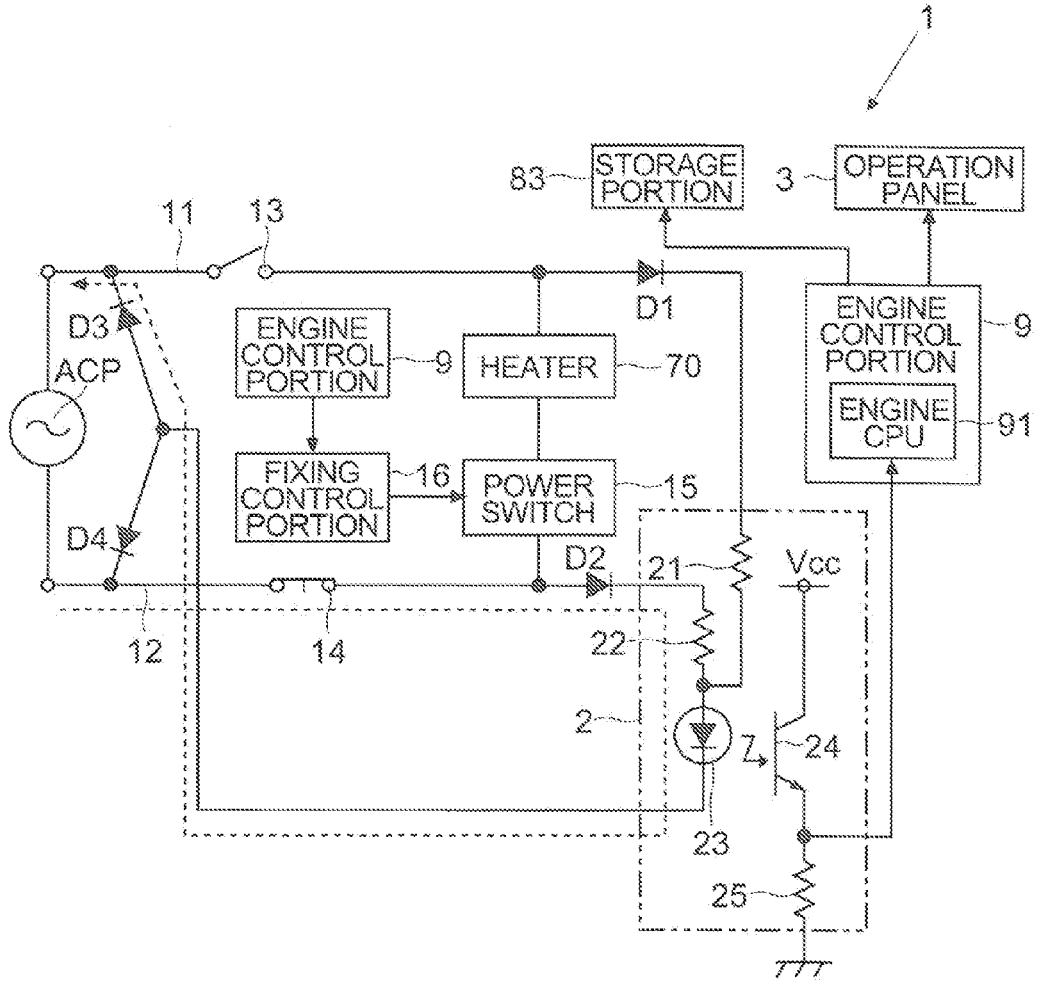
FIG. 9 is a circuit diagram illustrating a current flow in the status detection device according to the embodiment.
Figure 10:
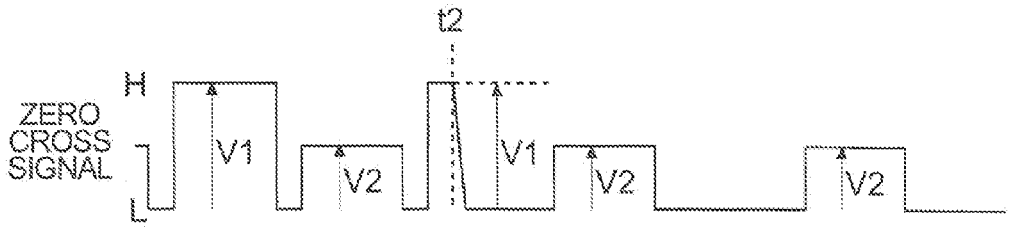
FIG. 10 is a timing chart illustrating an output of the zero cross signal generation portion according to the embodiment when a main switch is turned off.

Next, with reference to FIG. 9 and FIG. 10, there is described an example of an operation of the status detection device 1 and an output of the zero cross signal generation portion 2 when the power supply is interrupted by the main switch 13. FIG. 9 is a circuit diagram illustrating a current flow of the status detection device 1. FIG. 10 is a timing chart illustrating an output of the zero cross signal generation portion 2 when the main switch 13 is turned off.

First, a current flow in the status detection device 1 when the main switch 13 is turned off for disconnecting power supply is described with reference to FIG. 9. As illustrated in FIG. 9, when the main switch 13 is turned off, the first power line 11 becomes a non-conductive state. Therefore, the state where current is not supplied to the heater 70 is maintained.

In addition, as illustrated in FIG. 9, even when the voltage of the first power line 11 is higher than the voltage of the second power line 12, when the main switch 13 is turned off, current is not supplied to the light emitting portion 23 via the first diode D1 and the first resistor 21. Therefore, when potential of the first power line 11 is larger than potential of the second power line 12, the light emitting portion 23 does not emit light.

On the other hand, when the voltage of the second power line 12 exceeds the predetermined potential difference to become higher than the voltage of the first power line 11 as illustrated in FIG. 9, current flows from the AC power supply ACP to the light emitting portion 23 via the second diode D2 and the second resistor 22, so that the light emitting portion 23 emits light. Therefore, the zero cross signal generation portion 2 outputs the high level of the second output value V2 and outputs the low level in a period other than the period in which the high level is output at the second output value V2.

Therefore, a waveform of the zero cross signal when the main switch 13 is turned off (power supply is interrupted) is described with reference to FIG. 10. FIG. 10 illustrates an example of a waveform of the zero cross signal when the main switch 13 is turned off at the time point t2 indicated by a double-dotted-dashed line. When the main switch 13 is turned off, the zero cross signal generation portion 2 does not output the high level at the timing to output the high level at the first output value V1 (larger amplitude output value) when the main switch 13 is not turned off (does not rise at the first output value V1). Therefore, the engine control portion 9 (engine CPU 91) can recognize that the main switch 13 is turned off on the basis of the input zero cross signal. Specifically, the engine CPU 91 recognizes only the leading edge to the second output value V2 (smaller amplitude output value) in two periods (one period of the waveform of the AC power supply ACP) of a period of high level of the zero cross signal (time period from a leading edge to another leading edge). When a leading edge to the first output value V1 is not recognized, it is recognized that the main switch 13 is turned off.

When the main switch 13 is turned off, for example, power supply to the primary power supply portion 10*a* and power supply to the secondary power supply portion 10*b* are stopped. Therefore, similarly to the case where the power supply stop state occurs, the engine control portion 9 may control the storage portion 83 to store the predetermined type of data in a nonvolatile manner in a period until the main control portion 8 and the storage portion 83 are stopped.

(Recognition of Disconnection of Second Power Line 12 by Overheat Protection Portion 14)

Figure 11:
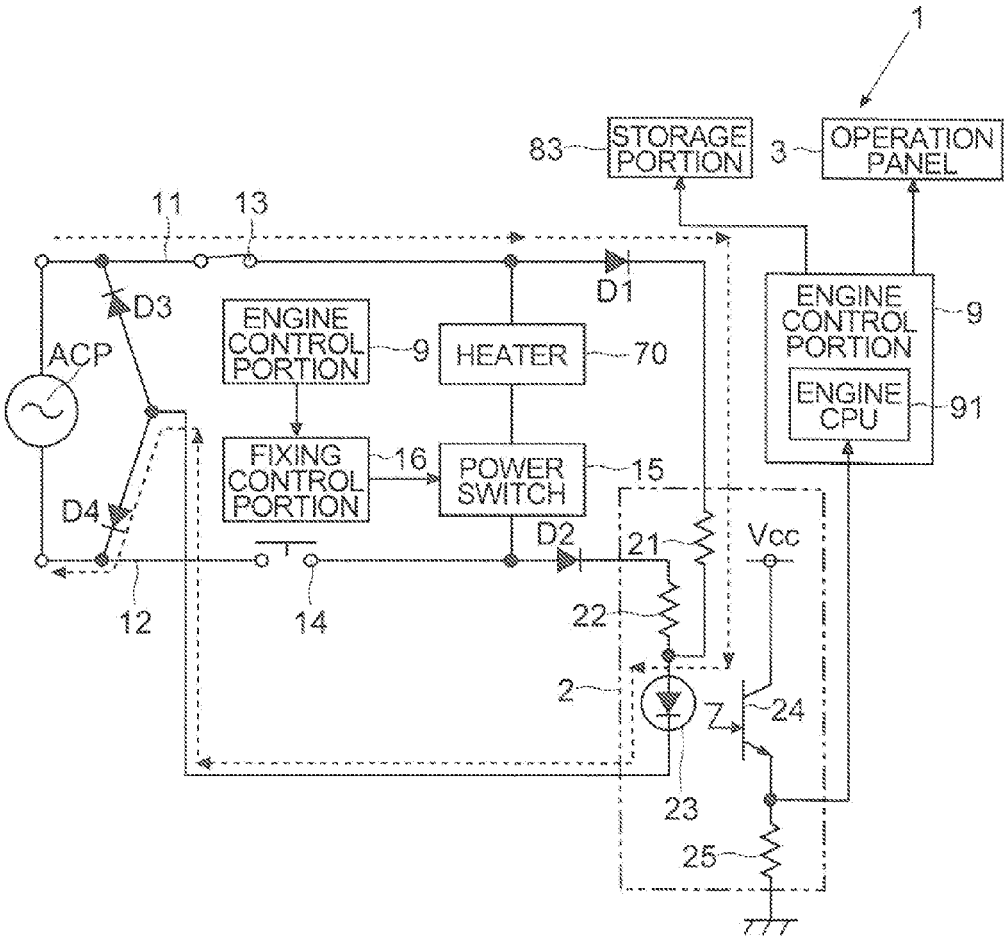
FIG. 11 is a circuit diagram illustrating a current flow in the status detection device according to the embodiment.
Figure 12:
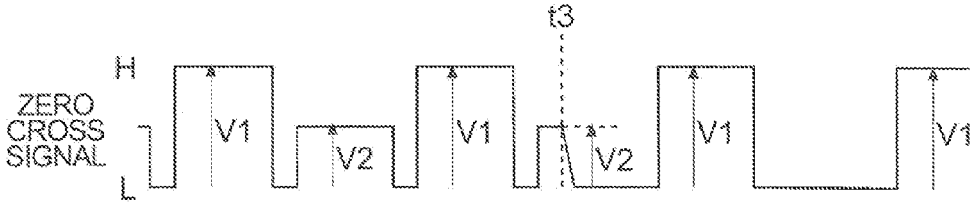
FIG. 12 is a timing chart illustrating an output of the zero cross signal generation portion according to the embodiment in a state where a second power line is disconnected by an overheat protection portion.

Next, with reference to FIG. 11 and FIG. 12, there is described an example of recognition of disconnection of the second power line 12 by the overheat protection portion 14 of the status detection device 1. FIG. 11 is a circuit diagram illustrating a current flow of the status detection device 1. FIG. 12 is a timing chart illustrating an output of the zero cross signal generation portion 2 in the state where the second power line 12 is disconnected by the overheat protection portion 14.

First, with reference to FIG. 11, a current flow in the status detection device 1 when the second power line 12 is disconnected by the overheat protection portion 14 is described. As illustrated in FIG. 11, when the overheat protection portion 14 detects excess temperature rise, the overheat protection portion 14 is opened so that the second power line 12 is disconnected. Therefore, the state where current is not supplied to the heater 70 is maintained. For instance, when the overheat protection portion 14 becomes the disconnected state, the disconnected state is maintained.

In addition, as illustrated in FIG. 11, even when a potential of the second power line 12 becomes higher than that of the first power line 11, when the overheat protection portion 14 works to cause disconnection of the second power line 12, current is not supplied to the light emitting portion 23 via the second diode D2 and the second resistor 22. Therefore, when the second power line 12 is disconnected, even when the potential of the second power line 12 is higher than that of the first power line 11, the light emitting portion 23 does not emit light.

On the other hand, as illustrated in FIG. 11, when the potential of the first power line 11 exceeds a predetermined potential difference and becomes higher than the potential of the second power line 12, current is supplied from the AC power supply ACP to the light emitting portion 23 via the first diode D1 and the first resistor 21, so that the light emitting portion 23 emits light. Therefore, the zero cross signal generation portion 2 outputs high level of the first output value V1 and outputs low level in a period other than the period in which high level of the first output value V1 is output.

Therefore, with reference to FIG. 12, there is described a waveform of the zero cross signal when the second power line 12 is disconnected by the operation of the overheat protection portion 14. FIG. 12 illustrates an example of the waveform of the zero cross signal when the disconnection occurs due to excess temperature rise at time point t3 indicated by a double-dotted-dashed line. When the second power line 12 is disconnected by the overheat protection portion 14, the zero cross signal generation portion 2 does not output high level (does not rise to the second output value V2) at the timing of outputting the high level of the second output value V2 (smaller amplitude output value) when the second power line 12 is not disconnected by the overheat protection portion 14.

Therefore, the engine control portion 9 (engine CPU 91) can recognize that the second power line 12 is disconnected by the overheat protection portion 14, on the basis of the input zero cross signal. Specifically, the engine control portion 9 recognizes only the leading edge of the first output value V1 (output value of the zero cross signal generation portion 2 corresponding to light emission of the light emitting portion 23 in the case where the voltage of the first power line 11 is larger than the voltage of the second power line 12, i.e., the larger amplitude output value), in two periods (one period of the waveform of the AC power supply ACP) of the period for the zero cross signal to be the high level (time period from a leading edge to another leading edge). Then, when the leading edge in the second output value V2 is not recognized, it is recognized that the second power line 12 is disconnected by the overheat protection portion 14.

(Flow of Detection by Status Detection Device 1)

Figure 13:
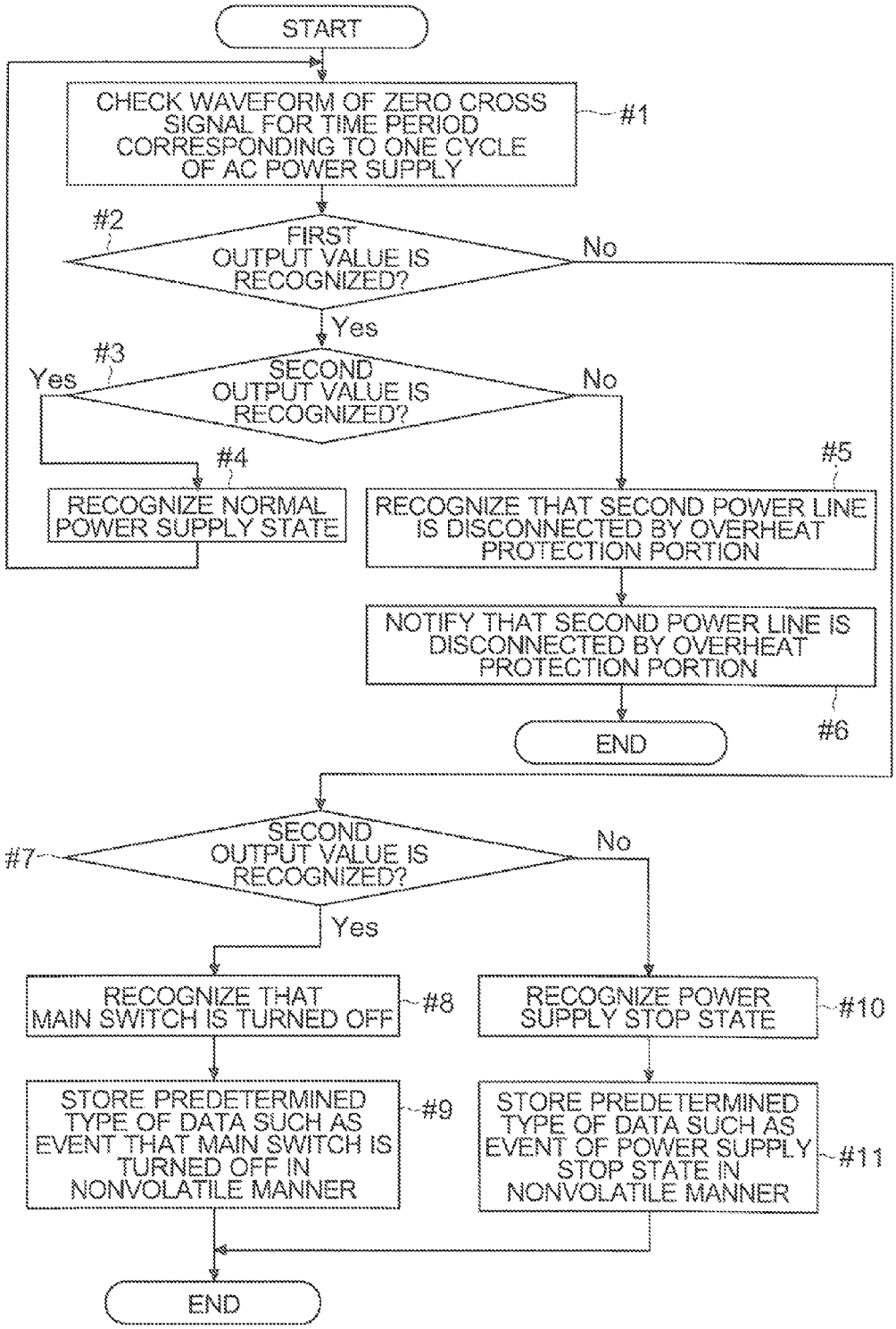
FIG. 13 is a flowchart illustrating a flow of status detection by the status detection device according to the embodiment.

Next, with reference to FIG. 13, an example of status detection by the status detection device 1 of this embodiment is described. FIG. 13 is a flowchart illustrating a flow of status detection by the status detection device 1.

For instance, the status detection by the status detection device 1 is performed during a period in which the engine control portion 9 (engine CPU 91) is working. Further, the flow of FIG. 13 starts at a time point when the main power is turned on so that the engine control portion 9 starts.

Further, the engine control portion 9 (engine CPU 91) checks the waveform of the zero cross signal for a predetermined time period (for example, a time period corresponding to one cycle (one period) of the AC power supply ACP) (Step #1). In other words, the engine control portion samples an output value of the zero cross signal at a constant interval a plurality of times during a predetermined time period (during one period).

Further, the engine CPU 91 checks whether or not the first output value V1 is recognized during the check period (whether or not the level has reached the first output value V1 as the high level) (Step #2). When the level has reached the first output value V1 (Yes in Step #2), the engine CPU 91 checks whether or not the second output value V2 is recognized during the check period (whether or not there is the high level reaching the second output value V2) (Step #3).

When reach to the first output value V1 and reach to the second output value V2 are recognized in the time period corresponding to one cycle (one period) of the AC power supply ACP (Yes in Step #3), the engine CPU 91 recognizes the normal power supply state (Step #4). Further, the flow returns to Step #1 because there is no special problem (to Step #1).

On the other hand, when the reach to the second output value V2 is not recognized though the reach to the first output value V1 is recognized in the time period corresponding to one cycle (one period) of the AC power supply ACP (No in Step #3), the engine CPU 91 recognizes that the second power line 12 is disconnected by the overheat protection portion 14 (Step #5). In this case, it is necessary to repair the printer 100, such as exchange of the overheat protection portion 14 or inspection of the heater 70. Therefore, the engine control portion 9 (engine CPU 91) controls the operation panel 3 to inform the user (to display) that the second power line 12 is disconnected by the overheat protection portion 14 (Step #6). Then, this flow is finished (END). Until the printer 100 is repaired, it is informed that the second power line 12 is disconnected by the overheat protection portion 14 every time when the main power is tamed on. Further, the main control portion 8 and the engine control portion 9 are maintained to control the printer 100 not to perform printing.

On the other hand, when the reach to the first output value V1 of the zero cross signal during the check period is not recognized (No in Step #2), the engine CPU 91 checks whether or not the second output value V2 is recognized during the check period (whether or not there was the high level reaching the second output value V2) (Step #7).

When the reach to the second output value V2 was recognized though the reach to the first output value V1 was not recognized during the time period corresponding to one cycle (one period) of the AC power supply ACP (Yes in Step #7), the engine CPU 91 recognizes that the main switch 13 is turned off (Step #8). Further, the predetermined type of data such as an event that the main switch 13 is turned off is stored in the storage portion 83 in a nonvolatile manner (Step #9). Further, after that, drive of the engine control portion 9 and the storage portion 83 is stopped, and this flow is finished (END).

On the other hand, when neither the reach to the first output value V1 nor the reach to the second output value V2 is recognized during the time period corresponding to one cycle (one period) of the AC power supply ACP (No in Step #7), the engine CPU 91 recognizes that the power supply stop state has occurred (Step #10). Further, the predetermined type of data such as an event that the power supply stop state has occurred due to power failure or disconnection of the power cable is stored in the storage portion 83 in a nonvolatile manner (Step #11). Further, after that, drive of the engine control portion 9 and the storage portion 83 is stopped, and this flow is finished (END).

In this way, the status detection device 1 of this embodiment includes the heater 70 for heating the toner image transferred onto the paper sheet, the first power line 11 for connecting the heater 50 to the AC power supply ACP so as to supply power to one end of the heater 70, the second power line 12 for connecting the heater 70 to the AC power supply ACP so as to supply power to the other end of the heater 70 (two power lines including the first power line 11 and the second power line 12 for connecting the heater 70 to the AC power supply ACP), the switch portion (main switch 13) disposed in the first power line 11 between the heater 70 and the AC power supply ACP so as to turn on and off the power supply, the overheat protection portion 14 disposed in the second power line 12 between the heater 70 and the AC power supply ACP so as to disconnect the second power line 12 when the temperature exceeds a predetermined temperature, and the zero cross signal generation portion 2 which outputs the zero cross signal on the basis of the voltage value of the first power line 11 between the switch portion and the heater 70 and the voltage value of the second power line 12 between the overheat protection portion 14 and the heater 70 in accordance with the waveform of the AC power supply ACP, and outputs the zero cross signals having different output values in the case where the voltage of the first power line 11 is higher than the voltage of the second power line 12 and in the case where the voltage of the second power line 12 is higher than the voltage of the first power line 11.

Thus, the single zero cross signal can include the information indicating whether to be a time slot in which the voltage of the first power line 11 is larger or a time slot in which the voltage of the second power line 12 is larger. In other words, it is possible to check that the output value when the voltage of the first power line 11 is larger and the output value when the voltage of the second power line 12 is larger are output alternately and repeatedly from the zero cross signal generation portion 2 by the single zero cross signal waveform, so as to recognize that power is normally supplied from the AC power supply ACP (to be the normal power supply state). In addition, when the output value when the voltage of the first power line 11 is higher and the output value when the voltage of the second power line 12 are larger are not output alternately and repeatedly from the zero cross signal generation portion 2, it is possible to recognize that the state where the power is not supplied at all (power supply stop state) has occurred due to disconnection of the power cable or power failure.

In addition, the switch portion (main switch 13) to be operated for turning on and off power supply for supply and interruption of power to the heater 70 is disposed in the first power line 11 between the heater 70 and the AC power supply ACP. Therefore, depending on the ON/OFF state of the switch portion, the waveform of the zero cross signal of the time slot in which the voltage of the first power line 11 is higher changes compared with the normal power supply state. Therefore, it is possible to superimpose information indicating ON/OFF of the switch portion on the zero cross signal. Further, when the temperature exceeds a predetermined temperature, because the overheat protection portion 14 for disconnecting the second power line 12 is disposed in the second power line 12 between the heater 70 and the AC power supply ACP, on the basis of whether or not the second power line 12 is disconnected by the overheat protection portion 14, the waveform of the zero cross signal of the time slot in which the voltage of the second power line 12 is larger changes compared with the normal power supply state. Therefore, it is possible to superimpose the information indicating whether or not the second power line 12 is disconnected by the overheat protection portion 14 (whether or not an excess temperature rise has occurred in such a manner that the disconnection is caused by the overheat protection portion 14) on the zero cross signal.

In this way, it is possible to superimpose information about many detection items (information indicating the status) on the single zero cross signal, and hence the number of sensors and signal lines can be reduced. Therefore, it is possible to simplify the wirings so as to reduce a space for wirings in the apparatus and manufacturing cost. In addition, the number of ports used in the control circuit can be reduced, manufacturing cost can be reduced, and flexibility of selecting the control circuit can be enhanced.

In addition, the zero cross signal generation portion 2 includes a light emitting portion 23 which emits light on the basis of current supplied through the first resistor 21 connected between the switch portion (main switch 13) and the heater 70 and current supplied through the second resistor 22 connected between the overheat protection portion 14 and the heater 70, and the light receiving portion 24 for receiving the light emitted from the light emitting portion 23 so as to deliver different output values in accordance with light intensity of the light emitting portion 23, in which the first resistor 21 and the second resistor 22 have different resistance values. Thus, by setting a difference of emitted light intensity of the single light emitting portion 23 between the first resistor 21 and the second resistor 22, it is possible that the zero cross signal contains the information indicating whether to be the time slot in which the voltage of the first power line 11 is larger or the time slot in which the voltage of the second power line 12 is larger.

In addition, the status detection device 1 includes the recognition portion (engine control portion 9), which is supplied with the output value of the zero cross signal generation portion 2 so as to recognize, in accordance with the output value of the status detection device 1, which one of the states is the current state, among the normal power supply state in which power from the AC power supply ACP is normally supplied, the state in which the power is turned off by the switch portion (main switch 13), the state where the second power line 12 is disconnected by the overheat protection portion 14, and the power supply stop state. Thus, the recognition portion can recognize the four states using a single signal line by supplying the zero cross signal from the zero cross signal generation portion 2 to the recognition portion (engine control portion 9).

In addition, the status detection device 1 includes the notifying portion (operation panel 3) for notifying the state recognized by the recognition portion (engine control portion 9). Thus, it is possible to permit the user to recognize the state.

In addition, the status detection device 1 includes the storage portion 83 for storing data. When the recognition portion (engine control portion 9) recognizes a change of the state, the storage portion 83 stores predetermined data in a nonvolatile manner. Thus, by determining data that should not be lost, in advance, it is possible to store the predetermined data in the storage portion 83 in the case where the power is turned off by the switch portion (main switch 13) or in the case where the power supply stop state occurs. Therefore, it is possible to prevent a desired type of data from being lost.

In addition, when the recognition portion (engine control portion) recognizes that the output value of the zero cross signal becomes the first output value V1 in predetermined time period (for example, time period longer than or equal to one period of the AC power supply ACP and shorter than several periods), when the recognition portion can recognize that the output value of the zero cross signal becomes the second output value V2 in the predetermined time, it recognizes the normal power supply state. When the recognition portion cannot recognize that the output value of the zero cross signal becomes the second output value V2 in the predetermined time, it recognizes the state where the second power line 12 is disconnected by the overheat protection portion 14. The first output value V1 is the output value when the zero cross signal becomes the high level in the case where the voltage of the first power line 11 is higher than the voltage of the second power line 12. The second output value V2 is the output value when the zero cross signal becomes the high level in the case where the second power line 12 is higher than the voltage of the first power line 11. Note that the second output value V2 is a value in a range to be lower than the first output value V1. Thus, it is possible to determine by one type of the zero cross signal whether the current state is the normal power supply state or the state in which the second power line 12 is disconnected by the overheat protection portion 14.

In addition, when the recognition portion (engine control portion) cannot recognize that the output value of the zero cross signal has become the first output value V1 in a predetermined time period (for example, time period longer than or equal to one period of the AC power supply ACP and shorter than several periods), the recognition portion recognizes the state where the power is turned off by the switch portion when it can recognize becoming the second output value V2 in the predetermined time period. When recognition portion cannot also recognize to be the second output value V2, it recognizes to be the power supply stop state. The first output value V1 is an output value when the zero cross signal becomes the high level in the case where the voltage of the first power line 11 is larger than the voltage of the second power line 12. The second output value V2 is an output value when the zero cross signal becomes the high level in the case where the voltage of the second power line 12 becomes higher than the voltage of the first power line 11. Note that the second output value V2 is a value in a range to be smaller than the first output value V1. Thus, it is possible to determine by one type of the zero cross signal whether to be the state where the power is turned off by the switch portion or the power supply stop state due to disconnection of the power cable or a power failure.

In addition, the image forming apparatus (printer 100) according to this embodiment includes the status detection device 1 which outputs the single zero cross signal on which information about many detection items are superimposed. Thus, it is possible to provide the image forming apparatus in which the number of signal lines is small, the wiring is simplified, a space for wiring in the apparatus is small, and manufacturing cost is reduced. In addition, it is possible to provide the image forming apparatus in which manufacturing cost of the control circuit such as the CPU 81 can be reduced, and flexibility of selecting the control circuit is high.

Although the embodiments of the present disclosure are described above, the scope of the present disclosure is not limited to this description, and can be embodied with various modifications within the scope without deviating from the spirit of the disclosure.

What is claimed is:

1. A status detection device comprising:

a heater for heating a toner image transferred onto a paper sheet;

a first power line for connecting the heater to an AC power supply so that power is supplied to one end of the heater;

a second power line for connecting the heater to the AC power supply so that power is supplied to the other end of the heater;

a switch portion disposed in the first power line between the heater and the AC power supply so as to turn on and off power supply;

an overheat protection portion disposed in the second power line between the heater and the AC power supply so as to disconnect the second power line when temperature exceeds a predetermined temperature; and a zero cross signal generation portion which outputs a zero cross signal on the basis of a voltage of the first power line between the switch portion and the heater and a voltage of the second power line between the overheat protection portion and the heater in accordance with a waveform of the AC power supply, and outputs zero cross signals having different output values in a case where the voltage of the first power line is higher than the voltage of the second power line and in a case where the voltage of the second power line is higher than the voltage of the first power line.

2. The status detection device according to claim 1, wherein the zero cross signal generation portion includes a light emitting portion for emitting light on the basis of current supplied through a first resistor connected between the switch portion and the heater and current supplied through a second resistor connected between the overheat protection portion and the heater, and a light receiving portion for receiving light emitted from the light emitting portion so as to output different values in accordance with light intensity of the light emitting portion, and the first resistor and the second resistor have different resistance values.

3. The status detection device according to claim 1, further comprising a recognition portion which is supplied with an output value of the zero cross signal generation portion so as to recognize to be one of states in accordance with the output value, the states including a normal power supply state in which power from the AC power supply is normally supplied, a state where the power is turned off by the switch portion, a state where the second power line is disconnected by the overheat protection portion, and a power supply stop state.

4. The status detection device according to claim 3, further comprising a notifying portion for notifying the state recognized by the recognition portion.

5. The status detection device according to claim 3, further comprising a storage portion for storing data, wherein when the recognition portion recognizes a change of the state, the storage portion stores predetermined data in a nonvolatile manner.

6. The status detection device according to claim 3, wherein when the recognition portion recognizes that an output value of the zero cross signal becomes a first output value in a predetermined time period, the recognition portion recognizes the normal power supply state when it can recognize to be a second output value in the predetermined time period, while recognizes the state where the second power line is disconnected by the overheat protection portion when it cannot recognize to be the second output value, the first output value is an output value when the zero cross signal becomes high level in the case where voltage of the first power line is higher than voltage of the second power line, and the second output value is an output value when the zero cross signal becomes high level in the case where voltage of the second power line is higher than voltage of the first power line.

7. The status detection device according to claim 3, wherein when the recognition portion cannot recognize that the output value of the zero cross signal has become a first output value in a predetermined time period, the recognition portion recognizes to be the state where the power is turned off by the switch portion when it can recognize to be a second output value in the predetermined time period, while recognizes to be the power supply stop state when it cannot recognize to be the second output value, the first output value is an output value when the zero cross signal becomes high level in the case where voltage of the first power line is higher than voltage of the second power line, and the second output value is an output value when the zero cross signal becomes high level in the case where voltage of the second power line is higher than voltage of the first power line.

8. An image forming apparatus comprising the status detection device according to claim 1.

9. A method for controlling a status detection device, the method comprising the steps of:

connecting a heater for heating a toner image transferred onto a paper sheet to an AC power supply with a first power line for supplying power to one end of the heater;

connecting the heater to the AC power supply with a second power line for supplying power to the other end of the heater;

turning on and off power supply by a switch portion disposed in the first power line between the heater and the AC power supply;

disconnecting the second power line by an overheat protection portion disposed in the second power line between the heater and the AC power supply when temperature exceeds a predetermined temperature;

outputting a zero cross signal on the basis of a voltage of the first power line between the switch portion and the heater and a voltage of the second power line between the overheat protection portion and the heater in accordance with a waveform of the AC power supply; and outputting the zero cross signals having different output values in a case where voltage of the first power line is higher than voltage of the second power line and in a case where voltage of the second power line is higher than voltage of the first power line.

10. The method for controlling a status detection device according to claim 9, further comprising the steps of:

controlling a light emitting portion to emit light on the basis of current supplied through a first resistor connected between the switch portion and the heater and current supplied through a second resistor connected between the overheat protection portion and the heater; and controlling a light receiving portion to receive the light emitted from the light emitting portion so as to output different values in accordance with light intensity of the light emitting portion, wherein the first resistor and the second resistor have different resistance values.

11. The method for controlling a status detection device according to claim 9, further comprising the step of recognizing to be one of states in accordance with an output value of the zero cross signal generation portion, the states including a normal power supply state in which power from the AC power supply is normally supplied, a state where the power is turned off by the switch portion, a state where the second power line is disconnected by the overheat protection portion, and a power supply stop state.

12. The method for controlling a status detection device according to claim 11, further comprising the step of notifying the recognized state.

13. The method for controlling a status detection device according to claim 11, further comprising the step of storing predetermined data in a nonvolatile manner when a change of the state is recognized.

14. The method for controlling a status detection device according to claim 11, further comprising when it can be recognized that an output value of the zero cross signal becomes a first output value in a predetermined time period, recognizing to be the normal power supply state when it can be recognized to be a second output value in the predetermined time period, while recognizing to be the state where the second power line is disconnected by the overheat protection portion when it cannot be recognized to be the second output value, wherein the first output value is an output value when the zero cross signal becomes high level in the case where voltage of the first power line is higher than voltage of the second power line, and the second output value is an output value when the zero cross signal becomes high level in the case where voltage of the second power line is higher than voltage of the first power line.

15. The method for controlling a status detection device according to claim 11, further comprising when it cannot be recognized that an output value of the zero cross signal becomes a first output value in a predetermined time period, recognizing to be the state where the power is turned off by the switch portion when it can be recognized to be a second output value in the predetermined time period, while recognizing to be the power supply stop state when it cannot be recognized to be the second output value, wherein the first output value is an output value when the zero cross signal becomes high level in the case where voltage of the first power line is higher than voltage of the second power line, and the second output value is an output value when the zero cross signal becomes high level in the case where voltage of the second power line is higher than voltage of the first power line.

* * * * *